US007107657B1

(12) United States Patent
Howell

(10) Patent No.: US 7,107,657 B1
(45) Date of Patent: Sep. 19, 2006

(54) LANYARD OPERATED STERNUM BREAKAWAY BUCKLE WITH VERTICAL POSITION ADJUSTMENT

(76) Inventor: Frank A. Howell, 15 Cotton La., Oxford, ME (US) 04270

( * ) Notice: Subject to any disclaimer, the term of this patent is extended or adjusted under 35 U.S.C. 154(b) by 900 days.

(21) Appl. No.: 10/274,632

(22) Filed: Oct. 21, 2002

Related U.S. Application Data

(63) Continuation-in-part of application No. 10/103,264, filed on Mar. 21, 2002.

(51) Int. Cl.
*A44B 11/25* (2006.01)
*A44B 17/00* (2006.01)

(52) U.S. Cl. ..... 24/614; 24/615; 24/625; 24/647; 24/664

(58) Field of Classification Search ..... 24/614, 24/615, 616, 625, 664, 647, 662, 635, 657, 24/658, 265 CD, 701
See application file for complete search history.

(56) References Cited

U.S. PATENT DOCUMENTS 3,947,932 A * 4/1976 Flynn ..... 24/616
4,282,634 A * 8/1981 Krauss ..... 24/323
4,864,700 A * 9/1989 Kasai ..... 24/579.09
4,924,562 A * 5/1990 Pogharian ..... 24/647
5,435,047 A * 7/1995 Colpo ..... 24/647
5,440,792 A * 8/1995 Ida ..... 24/615
5,709,014 A * 1/1998 Takahashi ..... 24/614
5,832,573 A * 11/1998 Howell ..... 24/664
6,154,936 A * 12/2000 Howell et al. ..... 24/625
6,360,410 B1 * 3/2002 Lovato ..... 24/662

* cited by examiner

*Primary Examiner*—Victor Sakran
(74) *Attorney, Agent, or Firm*—Samuels, Gauthier & Stevens

(57) ABSTRACT

A vertically positioned, lanyard, releasing breakaway buckle including a keeper and a secure. The keeper has a rear wall, side walls and a floor. A cover, to which a lanyard is secured, is hinged to the keeper and spaced apart from the floor. The cover defines an elongated slot. Apertures are formed inward from the side walls such that a strap may be fed through the apertures to vertically orient the buckle on a strap. The cover has a caming surface formed on the under surface of the cover, and which caming surface terminates in locking surface. An opening formed in the cover. A secure part includes a base, and a tongue section extending from the base. The tongue section has parallel guide arms extending from the rear wall forwardly, and terminating in leading ends, a member secured to the guide arms, and a caming surface formed in the tongue section. The caming surface terminates in a catch surface, whereby when the secure is received in the keeper, the caming surfaces engage and the cover deflects upwardly, the catch surface extends beyond the locking surface, the cover closes fastening the secure to the keeper.

7 Claims, 6 Drawing Sheets

LANYARD OPERATED STERNUM BREAKAWAY BUCKLE WITH VERTICAL POSITION ADJUSTMENT

CROSS REFERENCE

This application is a Continuation-in-Part of U.S. patent application Ser. No. 10/103,264, filed on Mar. 21, 2002.

BACKGROUND OF THE INVENTION

1. Field of the Invention

This invention is directed to a high load sternum breakaway high load buckle with a vertical position adjustment.

2. Description of the Prior Art

Web straps on light weight backpacks, rucksacks and hiking packs typically use "side-action" buckles to allow shoulder, compression and/or large pocket straps to be parted. This side-action buckle design has significant limitations when used in this capacity. The release tabs are recessed onto the sides of the buckle so they can be difficult to find and release when hurried or when wearing winter gloves. Both release tabs must be squeezed simultaneously toward each other to part the buckle. The hand force required to push the halves together and lock them cannot be increased/decreased without a proportional impact on the hand force required to unlock them. When separated, the exposed locking tabs of the male-half (tongue) of the buckle can be easily broken off and the female-half (body) can be crushed if stepped on.

When a person is wearing/using a backpack, the shoulder pads on backpacks have a tendency to spread apart and slip off the shoulders of the wearer as they walk or move about. Previously, one solution to this problem was to use a length of web strap spanning over the sternum to connect the shoulder pads. This "sternum strap" was anchored to the face of each shoulder pad with friction fittings that could be positioned vertically as desired. This configuration typically included a side-release buckle that allows the wearer to connect or part the strap as needed to put on or remove the backpack.

As discussed in the '264 application, there are many problems and limitations associated with the prior art including durability, ease of use, fingers being pinched, and difficulty in releasing the buckle when the buckle is under a heavy load. Additionally, suspending the release buckle over the sternum with a strap can cause chaffing and/or uncomfortable pressure on the wearer. If the strap gets twisted, it can make locating and releasing the buckle difficult. The buckle may also become caught in the wearer's clothing.

Another problem is that a side-release buckle does not open unless its release mechanism is operated or it breaks under heavy loading. If the need arises to quickly remove a backpack and the wearer does not have the presence of mind or opportunity to trigger the release feature, an injury may result. If the sternum strap is horizontally oriented, an additional piece of fitting hardware would be required.

SUMMARY OF THE INVENTION

Generally, the invention is directed to a release buckle vertically mounted to the surface of one of the shoulder pads. In this configuration the shoulder pad protects the wearer from the buckle, maintains the buckle predictably oriented, and free from becoming stuck in the wearer's clothing. To avoid the additional hardware required with the prior art horizontal buckle system, the design of the buckle incorporates means to pass both the strap on the shoulder pad through the buckle as well as the sternum strap. Additionally, the breakaway feature of the buckle has been achieved by modifying the locking surfaces to allow each piece of the buckle to slip past each other and release without damage. The amount of force required to achieve the breakaway feature can be altered, by varying the geometry of the buckle.

An object of this invention is to provide a vertically oriented sternum breakaway buckle.

Another object of this invention is to provide a vertical oriented buckle without added hardware.

Still another object of this invention is to provide a breakaway buckle that will not be damaged as the keeper and the secure parts move one past the other during release without functioning the operator.

Yet still another object of the invention is to provide a breakaway buckle, without functioning the operator, wherein the amount of force required to disengage the buckle can be altered by varying the geometry of the buckle.

BRIEF DESCRIPTION OF THE DRAWINGS

Other objects, features and advantages of the present invention will become more apparent as the description proceeds with reference to the accompanying drawings, wherein:

FIG. 3 is a top view of the buckle in FIG. 2 with a strap there through;

DETAILED DESCRIPTION OF THE INVENTION

Figure 1:
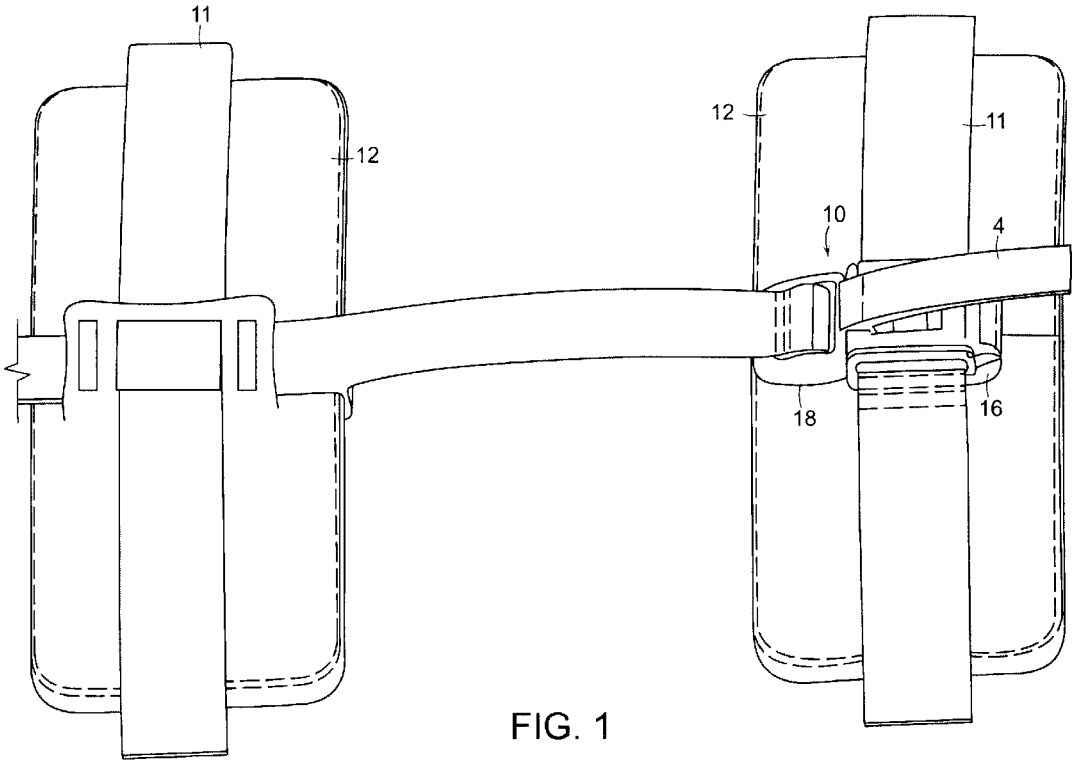
FIG. 1 is a portion of a backpack having a horizontally positioned breakaway buckles on each shoulder pad.

Referrng to FIG. 1, a lanyard operated sternum breakaway buckle is generally shown at 10. The sternum buckle 10 is horizontally positioned on a strap 11 on the shoulder pad 12 and a sternum strap 14 is connected between the two shoulder pads 12. The sternum strap 14 helps keep the shoulder pads 12 on the backpack wearer's shoulders during use, especially when carrying heavy loads or during a lot of physically activity. By placing the buckle 10 on the shoulder pad 12, there is less twisting of the sternum straps, a reduction of any chaffing and/or uncomfortable pressure on the wearer, the location keeps the buckle oriented such that the buckle does not tend to become twisted on the wearer, and it can make finding and releasing the buckle less difficult. The positioning means to vertically locate the buckle 10 on the pad of the shoulder strap 12, is incorporated into the back of the invention thus eliminating any requirement for any additional hardware, as was required with the prior art buckles.

The buckle 10 shown in FIGS. 1–6, includes comprises a keeper 16 and a secure part 18. The keeper comprises a floor 20, a back wall 22, side walls 24 and a cover 26. The cover 26 comprises a front edge 28, a back edge 30 and a flex point P. The cover defines with the floor 20 and side walls 24, an entrance slot 34. Openings 36 and a lanyard slot 38 are formed in the cover. Parallel guide ramps 40 define the slot 34 there between and terminate in catch surface 44.

Figure 2:
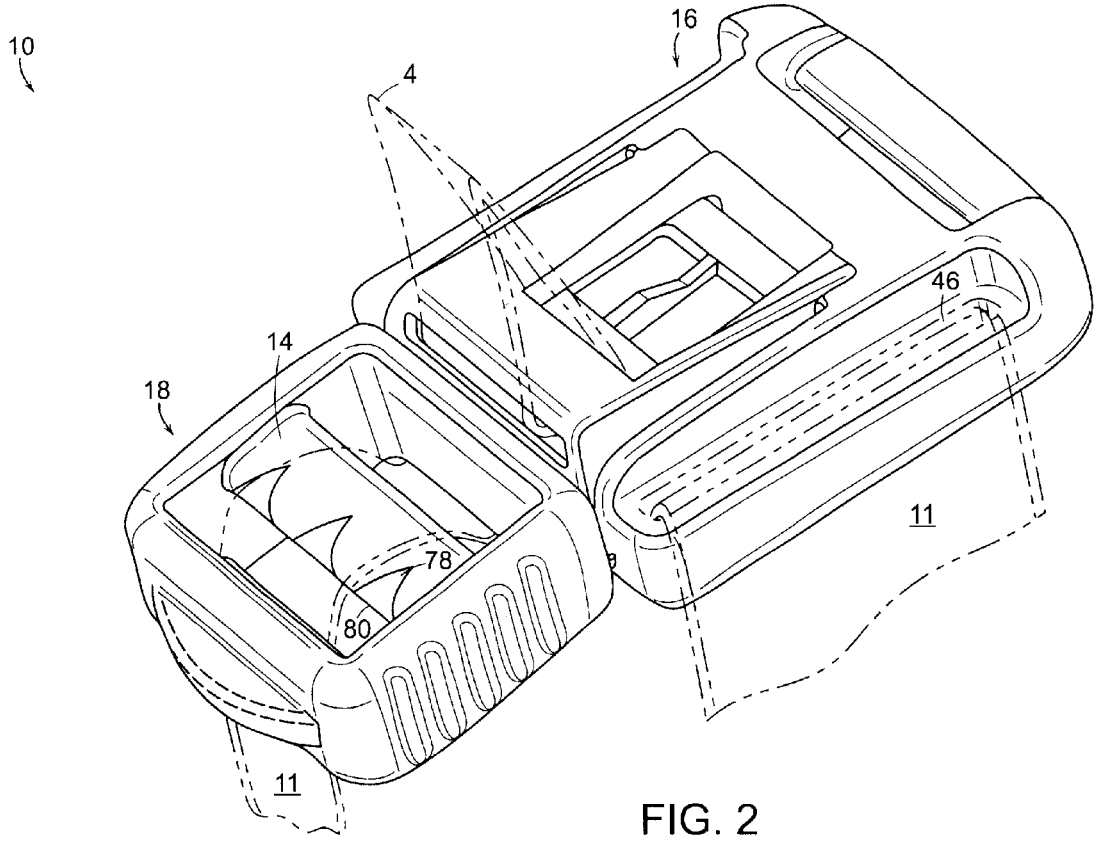
FIG. 2 is a perspective view of the vertical position breakaway buckle of the invention having a keeper part and a secure part engaged.
Figure 3:
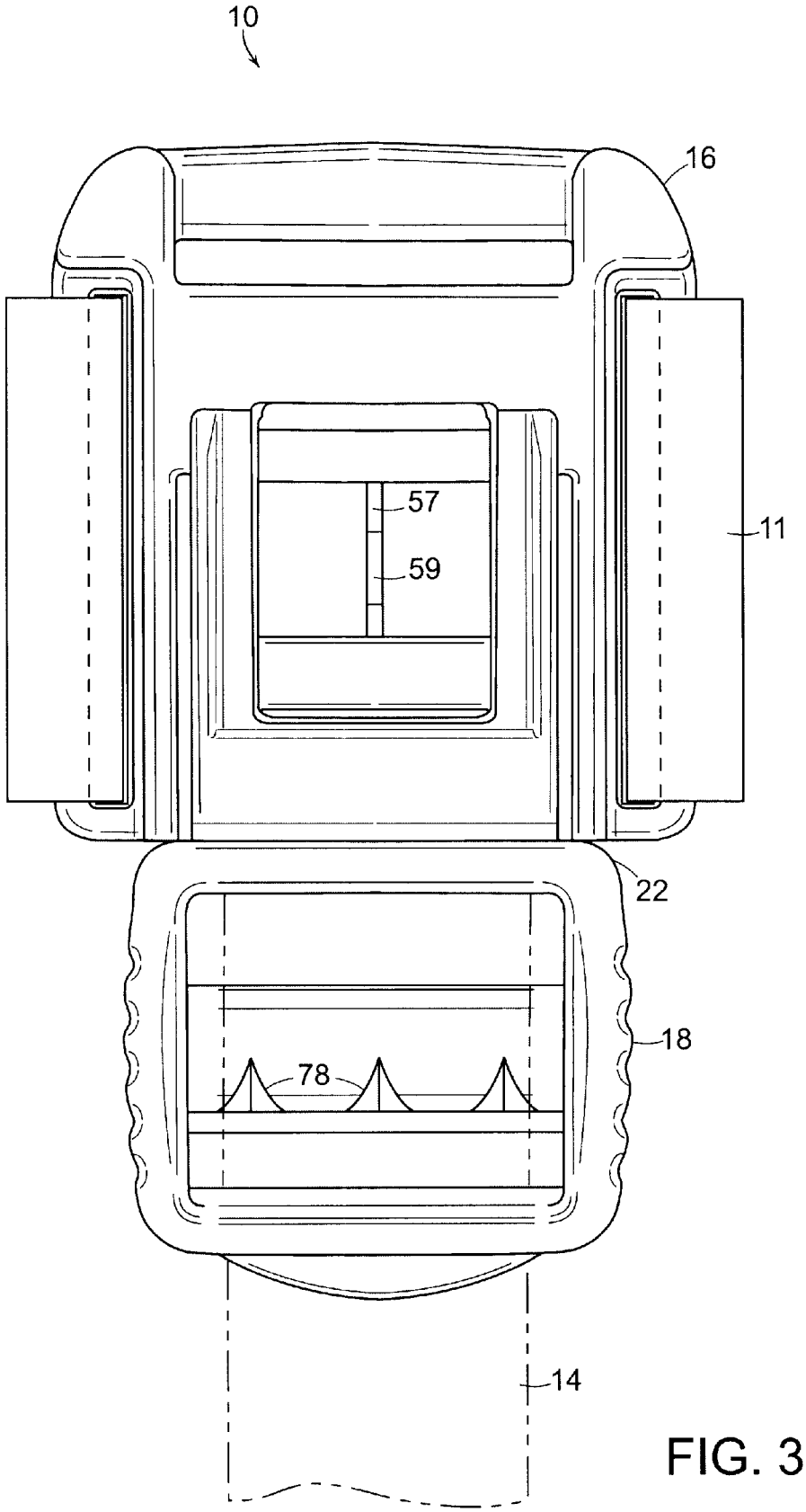
Figure 4:
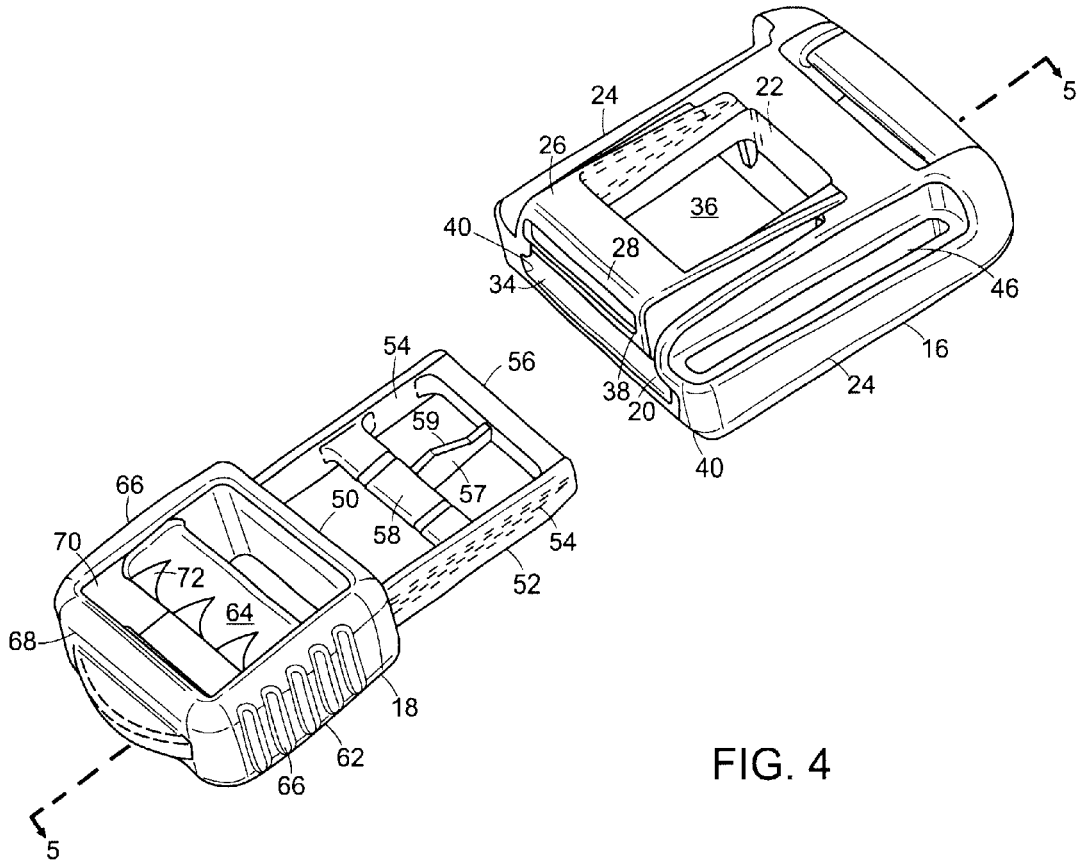
FIG. 4 is a perspective view of the buckle system.
Figure 5:
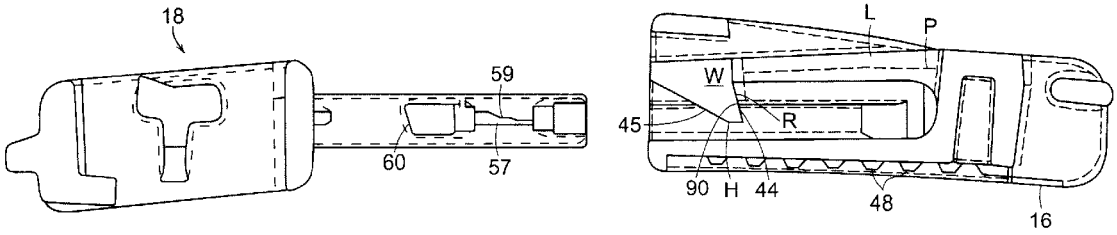
FIG. 5 is a sectional view taken along lines 5—5 of FIG. 4 of the FIG. 6 is a sectional view taken along lines 6—6 of FIG. 2 showing the secure partly engaged.
Figure 6:
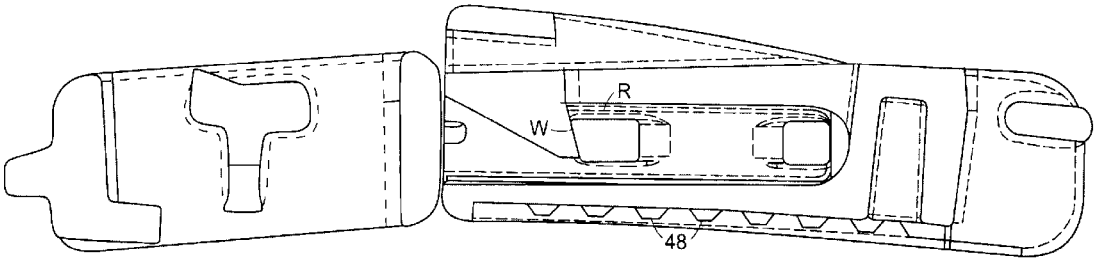

Parallel to the side walls 24 are side slots 46 through which the shoulder 11 strap passes through as seen in FIG. 2. As indicated in FIGS. 5 and 6, the inner edge of the bottome of the side slot includes protrusions 48 to help keep the buckle in place on the strap by adding friction.

The secure part 18, as indicated in the figures, comprises a rear wall 50 with a U-shaped tongue section 52 extending there from. The tongue section 52 includes two parallel guide arms 54. One end of each guide arm 54 is secured to the rear wall 50 and the other end of the guard arms 54 have secured thereto a flex member 56. Intermediate the rear wall 50 and the flex member 56 is a locking cross brace 58 which engages the catch surface 44 of the cover. The cross brace 58 has an angled locking surface 60. With reference to the catch surface 44 of the cover and the angled surface 60 of the locking cross brace, they are mirror imaged angled. A suitable range of angles is between 5 to 25°. Between the parallel guide arms 54 and connecting the flex member 56 and the locking cross brace 58 is a stabilizing cross bar 57. The cross bar has a sloped surface 59 to help flex up the cover 26 when engaging the secure part 18 to the keeper 16.

Secured to the rear of the rear wall 50 of the secure part 18 is a strap assembly 62. Extending from the back wall 50 is a strap locking section 64 having side walls 66, a back wall 68 and a saddle 70 characterized by 45° angled pyramidal shaped projections 72 extending there from. Access openings 74 are defined on either side of the saddle 70 and an adjustment strap 76 passes around the saddle. The shape of the pyramidal projections or teeth 72 are important. The teeth 72 comprise two slopes 78 and 80. The slope 78, at an angle of about 45°, makes it easier to tighten the strap, while the slope 80, at an angle of about 90°, makes it harder to loosen the strap.

The breakaway feature of the invention is achieved by modifying the geometry of the locking surfaces of the buckle to allow the surface to slip past each other and release without damaging either portion. The amount of force required to achieve this breakaway release can be increased or decreased as well by varying these geometries. Thus the buckle will pop open when a prerequisite amount of force is placed on the buckle, without using the normal operating procedures to open the buckle.

In the operation of the invention, the tongue section 52 is inserted into the entrance slot 34. The guide arms 54 are received in the slot 34 between the parallel guide ramps 40. As the secure 18 continues its travel in the keeper 16, the cross braces 58 engage the ramps 40, the sloped surface of the cross bar engages a sloped surface 45 of the catch surface 44, thereby deflecting the cover 26 upwardly along the pivot point P. The secure 18 continues to travel inwardly with the cross braces 58 sliding past the keeper surfaces 44. The cover 22 closes with the catch surfaces 44 and locking surfaces 58 engaging one another. The engagement of the members 48 biases the secure 18 in a rearward direction, thus securely holding the keeper and the secure part together without rattle.

During normal operating procedures, to disengage the secure 18 from the keeper 16, the lanyard L is drawn upwardly. The engaged catch/locking surfaces 44/58 slide by one another and the bias exerted by the members 48 facilitates removal of the secure from the keeper.

The catch surface 44 has a hook axis H. As tension on the locked buckle 10 is increased, the hook flexes on axis H with its pivot point located at its intersection with the lever's axis L, which is flexing as well, and pivoting at point P. The flexing moves the point of work W up the face of the secure where it transitions from the backwards sloping "fetching" surface 90 to the radius surface R. When the point of work moves far enough, the buckle pops open.

The amount of force required to part the buckle is a function of the rigidity of the keeper's lever on axis' H and L, the size of radius R, the slope of the fetching surfaces 90 and the length of those surfaces. Greater rigidity, smaller radius', steeper fetching surface slopes, and longer surfaces generate higher breakaway forces while the converse of these factors will reduce this force threshold. These factors can be used in various combinations to achieve more than just a desired breakaway force. For example, to make the buckle easier to lock and unlock, the lever can be made more flexible while not changing the breakaway threshold by reducing the radius, increasing the slope of the fetching surfaces, and/or increasing the length of the secure and keeper surfaces.

Although the present invention has been shown and described with respect to several preferred embodiments thereof, various changes, omissions and additions to the form and detail thereof, may be made therein, without departing from the spirit and scope of the invention.

What is claimed is:

1. A verticle positioned lanyard releasing breakaway buckle, the buckle comprising:

a keeper having a rear wall, side walls, and a floor, a cover, to which a lanyard is secured, hinged to the keeper spaced apart from the floor and between the walls, the floor, the walls, and the cover defining an elongated slot, apertures formed inward from the side walls such that a strap may be fed through the apertures to vertically orient the buckle on a strap;

a cover having a caming surface formed on the under surface of the cover, which caming surface terminates in locking surface, an opening formed in the cover;

a secure part comprising a base, a tongue section extending from the base, the tongue section comprising parallel guide arms extending from the rear wall forwardly, and terminating in leading ends, a member secured to the guide arms, a caming surface formed in the tongue section, the caming surface terminating in a catch surface, whereby when the secure is received in the keeper, the caming surfaces engage and the cover deflects upwardly, the catch surface extends beyond the locking surface, the cover closes fastening the secure to the keeper.

2. The buckle of claim 1 wherein the locking surface and the catch surfaces are mirror imaged angled with reference to one another.

3. The buckle of claim 1 wherein the inner surface of the walls of the keeper are characterized by grooves and the outer surfaces of the guide arms are characterized by mating rails.

4. A lanyard two-piece break away buckle assembly which comprises:

a keeper having a rear wall, side walls, and a floor, a cover, to which a lanyard is secured, hinged to the keeper spaced apart from the floor and between the walls, the floor, the walls, and the cover defining an elongated slot;

a cover having a caming surface formed on the under surface of the cover, which caming surface terminates in locking surface, an opening formed in the cover;

a secure part comprising a base, a tongue section extending from the base, the tongue section comprising parallel guide arms extending from the rear wall forwardly, and terminating in leading ends, a member secured to the guide arms, a cross member formed between the guide arms to form a catch surface, whereby when the secure is received in the keeper, the caming surfaces engage and the cover deflects upwardly, the catch surface extends beyond the locking surface, the cover closes fastening the secure to the keeper, such that when the secure part becomes disengaged from the keeper the caming surface due to increased force, the catch surface glide past each other without causing breakage to the buckle.

5. The buckle of claim 4, wherein apertures formed inward from the side walls such that a strap may be fed through the apertures to vertically orient the buckle on a strap.

6. The buckle of claim 4, wherein the force required to release the secure part from the keeper without applying force to a lanyard attached to the cover, may be altered by changing the angle of the catch surface, the curvature of the caming surface, the length of the secure part and the keeper.

7. The buckle of claim 4 wherein the locking surface and the catch surfaces are mirror imaged angled with reference to one another.

* * * * *